United States Patent [19]

Kitagawa et al.

[11] Patent Number: 5,073,794

[45] Date of Patent: Dec. 17, 1991

[54] IMAGE DUPLICATING APPARATUS IN WHICH USER SPECIFIED OPERATIONAL CONDITIONS ARE STORED AND USED BASED ON THE DETECTED NATURE OF THE DOCUMENT BEING COPIED

[75] Inventors: Tsuneo Kitagawa; Kazuhiro Araki, both of Osaka, Japan

[73] Assignee: Minolta Camera Kabushiki Kaisha, Osaka, Japan

[21] Appl. No.: 634,965

[22] Filed: Jan. 3, 1991

Related U.S. Application Data

[63] Continuation of Ser. No. 199,785, May 27, 1988, abandoned.

[30] Foreign Application Priority Data

May 30, 1987 [JP] Japan ..... 62-137214

[51] Int. Cl.[5] ..... G03G 21/00; G03G 15/04

[52] U.S. Cl. ..... 355/208; 355/243; 355/311

[58] Field of Search ..... 355/203, 204, 208, 243, 355/311, 313

[56] References Cited

U.S. PATENT DOCUMENTS 4,442,505 4/1984 Takano ..... 355/313 X
4,572,653 2/1986 Ito et al. ..... 355/208 X
4,575,227 3/1986 Ito et al. ..... 355/311 X
4,609,283 9/1986 Murata et al. ..... 355/208
4,688,924 8/1987 Anzai et al. ..... 355/323
4,816,864 3/1989 Tanaka et al. ..... 355/308

FOREIGN PATENT DOCUMENTS 56-83754 7/1981 Japan .
57-181559 11/1982 Japan .

*Primary Examiner*—Fred L. Braun
*Attorney, Agent, or Firm*—Burns, Doane, Swecker & Mathis

[57] ABSTRACT

An image duplicating apparatus in which data representative of operational conditions in accordance with which a document sheet is to be duplicated are entered by the user and the natures of document sheets to be duplicated are detected. The data are stored in memory areas of a memory which are respectively assigned to the natures of document sheets. Any one of the memory areas is selected from the memory for the data representative of the operational condition for one of the natures of document sheets written into a selected one of the memory areas and is then read from the storage device for the individual detected natures of document sheets. The copying operation is performed in accordance with the operational conditions represented by the data read by the data read arrangement.

12 Claims, 8 Drawing Sheets

IMAGE DUPLICATING APPARATUS IN WHICH USER SPECIFIED OPERATIONAL CONDITIONS ARE STORED AND USED BASED ON THE DETECTED NATURE OF THE DOCUMENT BEING COPIED

This application is a continuation of application Ser. No. 07/199,785, filed May 27, 1988, now abandoned.

FIELD OF THE INVENTION

The present invention relates to an image duplicating apparatus and particularly to an image duplicating apparatus of the type having a programmed mode of copying operation.

BACKGROUND OF THE INVENTION

When a plurality of document sheets of a particular nature common to the sheets are to be copied, the operator is required to enter the desired operational conditions for the copying of the document sheets. Such operational conditions typically include the number of the printed outputs to be produced and the reduction/-magnification ratio and the print color to be used for the copying operation.

It is sometimes desired to duplicate document sheets of one nature and thereafter those of another nature. If it is desired that the two sets of document sheets be duplicated in different operational conditions, the operator is required to enter the conditions for copying operation for the document sheets of one nature and, upon completion of the copying of these document sheets, further enter the conditions for copying operations for the document sheets of the other nature. Duplication of document sheets of different natures thus requires the operator to enter the desired operational conditions for each set of document sheets having a common nature so that the operator is not allowed to leave the machine to continuously operate until the duplication of all the document sheets is complete.

Improvements have been made to eliminate such an inconvenience experienced in a prior-art image duplicating apparatus. One of these improvements is disclosed in Japanese Provisional Patent Publication (Kokai) No. 56-83754. In the image duplicating apparatus therein taught, document sheets of different natures are grouped depending on the operational conditions in accordance with which the document sheets are to be duplicated. The operational conditions to be used for these sets of document sheets are entered by the operator and stored into the apparatus for each set of document sheets. The plurality of sets of document sheets thus grouped are separated by separator plates each interposed between two sets of document sheets. Termination of the copying operation for one of these two sets of document sheets is detected through detection of the separator plate which has been present between the two sets of document sheets. Each time the presence of a separator plate is detected, the operational conditions for the copying of the next set of document sheets are read out and, copying operation is performed in accordance with the conditions thus read out. An improved version of this type of image duplicating apparatus is disclosed in Japanese Provisional Patent Publication (Kokai) No. 60-136760 in which data sheets each identifying a set of document sheets of a particular nature are used in lieu of the separator plates.

Problems still remain in prior-art image duplicating apparatus of the described types particularly in that the grouping of the document sheets to be duplicated and the use of the separator plates or data sheets require some additional jobs to be performed by the operator.

SUMMARY OF THE INVENTION

The present invention contemplates elimination of such problems inherent in known image duplicating apparatus of the described types.

In accordance with one outstanding aspect of the present invention, there is provided an image duplicating apparatus comprising a) detecting means for detecting respective natures of document sheets to be duplicated, b) input means for entering data representative of operational conditions, c) data storage means having a plurality of memory areas for storing the data representative of the respective operational conditions, the memory areas being respectively assigned to the natures of document sheets, d) selecting means for selecting any one of the memory areas, e) data write means for writing into selected ones of the memory areas the data representative of the operational condition, f) data read means for reading from the storage means the data representative of the operational conditions for the individual natures of document sheets, the data representative of the operational conditions being read from the memory areas which correspond respectively to the natures of document sheets detected by the detecting means, and g) copying operation performing means for performing copying operations in accordance with the operational conditions represented by the data read by the data read means.

In accordance with another outstanding aspect of the present invention, there is provided an image duplicating apparatus comprising a) detecting means for detecting respective natures of document sheets to be duplicated, b) input means for entering data representative of operational conditions in accordance with which a document sheet having any of the natures is to be duplicated, c) data storage means for storing the data representative of the respective operational conditions for the natures of document sheets, and d) copying operation performing means for reading from the storage means the data representative of the operational conditions for the individual natures of document sheets detected by the detecting means, and for performing copying operation in accordance with the operational conditions represented by the data read from the storage means.

In accordance with still another outstanding aspect of the present invention, there is provided an image duplicating apparatus comprising a) document feed means for successively feeding document sheets to a predetermined position, b) detecting means for detecting respective natures of document sheets each fed or to be fed to the predetermined position, c) input means for entering data representative of operational conditions in accordance with which a document sheet having any of the natures is to be duplicated, d) data storage means for storing the data representative of the respective operational conditions for the natures of document sheets, and e) copying operation performing means for reading from the storage means the data representative of the operational conditions for the individual natures of document sheets detected by the detecting means, and for performing copying operation for a document sheet fed to the predetermined position, the performing copying operation being performed in accordance with the operational conditions represented by the data read from the storage means.

The document feed means may be implemented by an automatic document feed module and, in this instance, the desired operational conditions such as typically the desired number of the printed outputs to be produced are manually keyed in and thus entered through the input means for each of the different natures or sizes of the document sheets set on the automatic document feed module. Different modes of copying operation are thus stored into the apparatus for the different natures or sizes of the document sheets to be duplicated. The copying operation is then started with, for example, a print start key depressed by the operator and is executed in accordance with the operational conditions thus memorized.

Each time a document sheet is to be scanned, the nature of the document sheet is detected and data representative of the desired operational conditions for the detected nature is fetched from a particular one of the memory areas of the memory means, whereupon duplication of the document sheet is executed in accordance with the data thus read from the particular memory area. Copying operations are thus performed successively from a document sheet of a particular nature to a document sheet of the same nature or even from a document sheet of a particular nature to a document sheet of another nature.

Where such an automatic document feed module is not used in an image duplicating apparatus according to the present invention, operational conditions desired for document sheets of different natures or sizes are also preliminarily entered through the input means of the apparatus. The operator of the apparatus is thus not required to newly key in the operational conditions when a copying operation for document sheets of one nature is complete and a copying operation for document sheets of another nature is to be started.

BRIEF DESCRIPTION OF THE DRAWINGS

The features and advantages of an image duplicating apparatus according to the present invention will be more clearly appreciated from the following description taken in conjunction with the accompanying drawings in which.

DESCRIPTION OF THE PREFERRED EMBODIMENT

Figure 1:
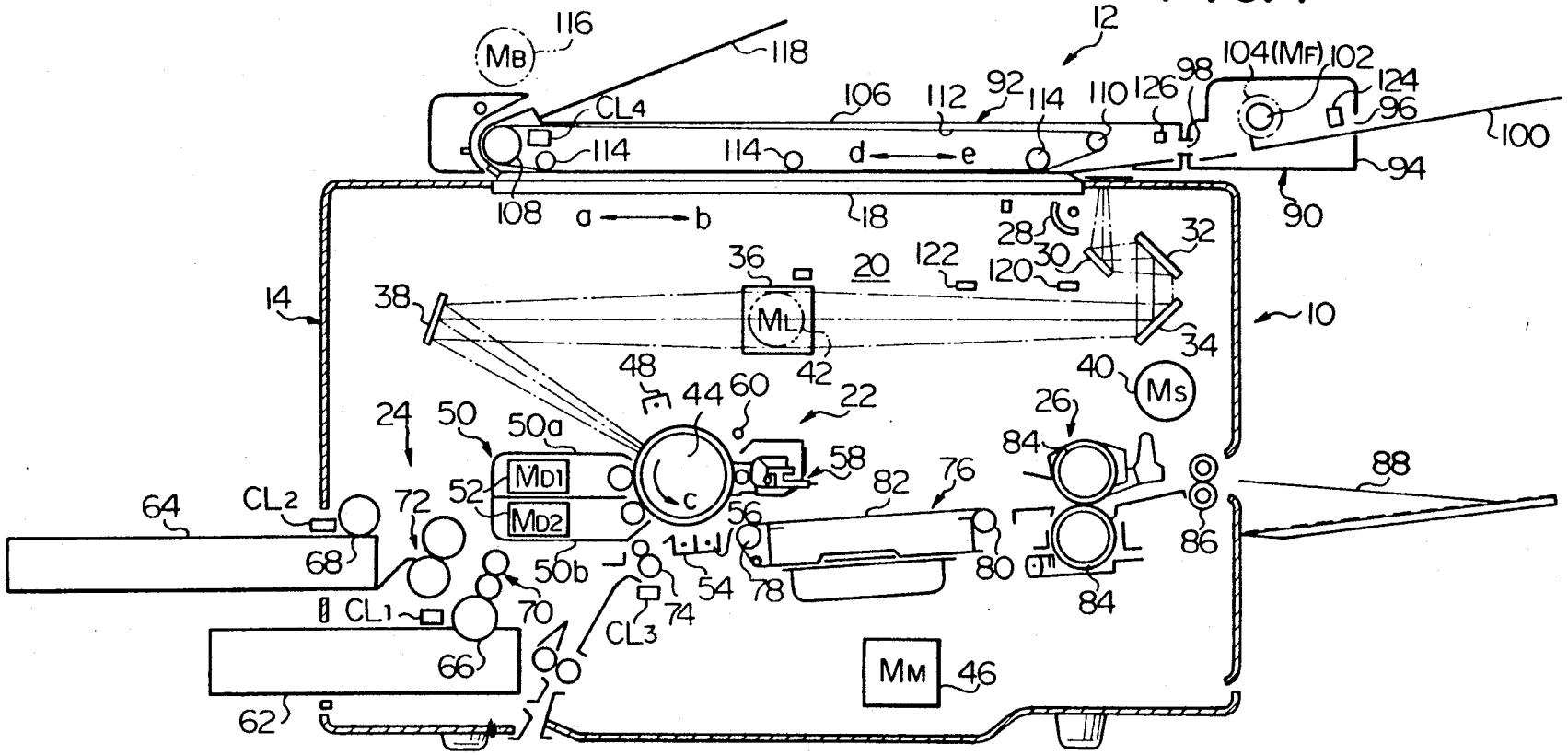
FIG. 1 is an elevation view showing the general mechanical construction and arrangement of a preferred embodiment of an image duplicating apparatus according to the present invention.

A preferred embodiment of an automated image duplicating apparatus according to the present invention will be hereinafter described with reference to the drawings, first particularly to FIG. 1 which shows the general mechanical construction and arrangement of such an embodiment. As shown in FIG. 1, the image duplicating apparatus embodying the present invention largely consists of a main module implemented by an electrophotographic duplicator module 10, and an optional or subsidiary module implemented by an automatic document feed module 12 positioned atop the duplicator module 10.

Duplicator Module (Main Module)

The duplicator module 10 implementing the main module of the apparatus embodying the present invention has a housing structure 14 including an upper panel portion which is in part provided by a transparent document support table 18. A sheet of document bearing images to be reproduced is to be placed on this document support table 18, though not shown in the drawings.

The duplicator module 10 further comprises an optical scanning system 20, an image reproducing system 22, a paper feed mechanism 24 and an image fixing assembly 26. The optical scanning system 20 comprises a light exposure lamp 28 from which a beam of light is incident on and reflected from the lower face of the document sheet on the document support table 18. The reflected light is downwardly incident onto an object mirror 30 and is re-directed rearwardly. The exposure lamp 28 and object mirror 30 are movable together along the document support table 18 as indicated by arrows a and b.

The light reflected by the object mirror 30 is redirected toward a mirror 32, which further re-directs the light downwardly toward another mirror 34. The mirrors 32 and 34 are also movable along the document support table 18 into and out of predetermined home positions indicated by full lines. From the mirror 34, the light travels forwardly along the document support table 18 and is passed through an image magnification/reduction lens unit 36 (hereinafter referred to simply as magnification lens unit) to a projecting mirror 38. The lens unit 36 is movable along the document support table 18 independently of the exposure lamp 28 and mirrors 30, 32 and 34 with respect to the table 18. Movement of the lens unit 36 in either direction with respect to the mirror 38 results in a change in the ratio of magnification or reduction (hereinafter referred to simply as magnification) of the images to be reproduced. The exposure lamp 28 and mirror 30 are operatively coupled to common drive means and travel at a speed doubling the speed of movement of the mirrors 32 and 34. Such drive means is assumed to include a d.c. scanner drive motor 40 ($M_S$). The lens unit 36 is also operatively coupled to appropriate drive means, which is assumed to include a pulse-driven stepper motor 42 herein referred to as lens drive motor ($M_L$). It is herein further assumed that the lamp 28 and object mirror 30 implement, in combination, a document scanner 28/30 in the scanning system 20. The document scanner 28/30 has, with respect to the document support table 18, a predetermined home position which corresponds to one end of the table 18.

The image reproducing system 22 comprises a cylindrical image transfer drum 44 having a conductive peripheral surface layer coated with a photoconductive substance. The light incident on the image reproducing system 22 is re-directed toward this image transfer drum 44 and is focused onto the peripheral surface of the drum 44. The image transfer drum 44 is driven for rotation in a direction indicated by arrow c by appropriate drive means, which is assumed to include a main drive motor 46 ($M_M$). The exposure lamp 28 and mirror 30 and the mirrors 32 and 34 are driven for movement at speeds proportional to the peripheral speed (V) of rotation of the image transfer drum 44. On the other hand, a change in the position of the lens unit 36 with respect to the peripheral surface of the image transfer drum 44 results in a change in the magnification/reduction ratio (N) of the images to be reproduced. In the embodiment herein shown, it is assumed that the exposure lamp 28 and mirror 30 are driven for movement at a speed V/N and the mirrors 32 and 34 at a speed V/2N.

The image reproducing system 22 further comprises a main charger 48 to sensitize the photoconductive peripheral surface of the image transfer drum 44 by applying electrostatic charges uniformly to the surface of the drum 44. These charges are dissipated in areas exposed to light and electrostatic latent images are created by the charges remaining on the image transfer drum 44 upon irradiation with light from the mirror 38. Posterior to the path of light to the image transfer drum 44 is located an image developing stage 50 which is shown comprising two developing units 50*a* and 50*b* respectively having stocks of differently colored toner particles to be applied to the photoconductive peripheral surface of the drum 44. Visible toner images are thus produced conformingly to the latent images on the image transfer drum 44. The image developing units 50*a* and 50*b* have develop motors 52 ($M_{D1}$, $M_{D2}$) respectively incorporated therein.

Posterior to the image developing stage 50 in turn is provided an image transfer charger 54 which is operative to apply electrostatic charges to a copying sheet so that the toner images on the image transfer drum 44 are transferred to the copying sheet. The copying sheet thus having the toner images carried thereon is cleared of charges by a separation charger 56 located posterior to the image transfer charger 54. There is further provided a drum cleaner unit 58 which removes any residual toner particles from the peripheral surface of the image transfer drum 44. Posterior to this cleaner unit 58 in turn is positioned a charge eraser lamp 60 which irradiates the cleaned peripheral surface of image transfer drum 44 to eliminate the charges which may be left thereon. Though not shown, each of the chargers 48, 54 and 56, developing and cleaner units 50 and 58 and eraser lamp 60 includes or is associated with appropriate drive or actuator means.

The paper feed mechanism 24 is provided in conjunction with lower and upper paper supply cassettes 62 and 64 which are detachably fitted to the housing structure 14 and which have stocks of copy sheets of different sizes encased therein. The paper feed mechanism 24 comprises lower and upper paper feed rollers 66 and 68 each of which is driven for rotation to pick up copy sheets one after another from the stack of paper in the cassette 62 or 64. The copy sheet picked up by the lower paper feed roller 66 is guided directly toward the image transfer drum 44. The feed roller 66 is held in rollable contact with one of a pair of guide rollers 70 which are held in rollable contact with each other. In association with the upper paper supply cassette 64 is provided a pair of guide rollers 72 which are held in rollable contact with each other and which are located between the upper paper feed roller 68 and the pair of guide rollers 70. A copy sheet picked up by the upper paper feed roller 64 is first passed between the guide rollers 72 and subsequently between the guide rollers 70 and is thereafter directed toward the image transfer drum 44.

The paper feed rollers 66 and 68 are operatively connected to the main drive motor 46 through suitable actuator means such as solenoid-operated clutches schematically indicated at $CL_1$ and $CL_2$, respectively. Posterior to the developing stage 50 is provided a pair of timing rollers 74 which are held in rollable contact with each other. A copy sheet passed from the lower paper feed roller 66 or through the guide rollers 70 is passed to the timing rollers 74. The timing rollers 74 are to be driven for rotation at a timing synchronized with the movement of the document scanner 28/30. The timing rollers 74 are operatively connected to the main drive motor 42 through a solenoid-operated clutch schematically indicated at $CL_3$.

The paper feed mechanism 18 further comprises a copy-sheet transport belt assembly 76 positioned posterior to the area where the copy sheet is to be separated from the image transfer drum 44. The transport belt assembly 76 comprises spaced driven and idler rollers 78 and 80 and an endless transport belt 82 passed between the rollers 78 and 80.

The image fixing assembly 26 is provided at the rear of the transport belt assembly 76 and comprises a pair of heater rollers 84 arranged to form therebetween a nip aligned with the path of travel of a copy sheet from the belt assembly 76. The copy sheet transported on the transport belt assembly 76 is thus nipped between the heater rollers 84 so that the toner particles carried on the sheet are thermally fused and the toner images are fixed on the copy sheet. Past the belt assembly 76 is provided a pair of guide rollers 86, through which a copy sheet passed from the image fixing assembly 26 is withdrawn to a paper collect tray 88 and a discharge slot provided in the housing structure 14.

Automatic Document Feed (ADF) Module (First Subsidiary Module)

The automatic document feed module 12 implementing the first subsidiary module of the apparatus embodying the present invention largely comprises a document supply unit 90 and a document transport unit 92 which are arranged horizontally in a direction of forward advancement of a document sheet as indicated by arrow d. The document supply unit 90 comprises a housing 94 having inlet and outlet slots 96 and 98, a document supply tray 100 extending into the housing 94 through the inlet slot 96, and a document feed roller 102 positioned on top of the document supply tray 100. The document feed roller 102 is driven for rotation by means of a roller drive motor $M_F$ also positioned within the housing 94 as schematically indicated at 104. A document sheet (not shown) to be copied may be placed on the document supply tray 100 through the inlet slot 96 so that the document sheet can be passed into the document transport unit 92 through the outlet slot 98 in the housing 94.

This document transport unit 92 comprises a lid structure 106 and is arranged to be rockable in its entirely away from and toward the document support table 18 about an axis extending lengthwise of the transport unit 92. The lid structure 106 comprises a conveyor mechanism including driven and idler rollers 108 and 110 spaced apart in parallel from each other and positioned in the vicinity of the front and rear ends, respectively, of the document transport unit 92. An endless transport belt 112 is passed between these rollers 108 and 110 and has a lower travelling path portion which extends in parallel with the document support table 18 and which is to travel in the direction of advancement d of a document sheet. The document transport unit 92 as a whole is thus rockable between a "closed" angular position having the lower travelling path portion of the belt 112 held in slidable contact with the document support table 18 as shown and an "open" angular position spaced apart from the document support table 18. Between the driven and idler rollers 108 and 110 are arranged guide and pressing rollers 114 which are held in rollable contact with the inner surface of the lower travelling path portion of the belt 112 to press the lower travelling path portion of the belt 112 slidably against the upper face of the document support table 18 when the document transport unit 92 is maintained in the closed position. The driven roller 108 is driven for rotation about its center axis by means of a belt drive motor $M_B$ which is schematically indicated at 116. A document sheet supplied from the document supply unit 90 to the document transport unit 92 is moved by the transport belt 112 to a correct "exposure position" on the document support table 18 and is ready to be scanned by the optical scanning system 20 of the duplicator module 10. After the document sheet set on the document support table 18 is thus scanned by the optical scanning system 20, the document sheet is withdrawn to a document recovery tray 118 forming part of the lid structure 106 and a subsequent document sheet on the document supply tray 100 is transferred to the document support table 18. This operation is repeatedly performed until the document supply tray 100 is evacuated. The driven roller 108 is operatively connected to the belt drive motor 108 through suitable actuator means such as a solenoid-operated clutch schematically indicated at $CL_4$.

Sensors and Detectors

The image duplicating apparatus embodying the present invention further comprises various sensors and detectors arranged within the main and subsidiary modules 10 and 12. Such sensors and detectors include those provided in association with the optical scanning system 20 of the duplicator module 10. The sensors associated with the optical scanning system 20 include a home position sensor 120 and scan timing sensor 122 both located in association with, for example, the document scanner 28/30. The home position sensor 120 is responsive to movement of the document scanner 28/30 to and from a predetermined home position with respect to the document support table 18 and is adapted to produce an output signal $S_{HP}$ of a logic "1" state in the presence of the document scanner 28/30 in the home position. The scan timing sensor 122 is responsive to the movement of the document scanner 28/30 to produce an output signal $S_{ST}$ of a logic "1" state in response to movement of the scanner 28/30 over a predetermined distance from the home position thereof.

On the other hand, the automatic document feed module 12 of the apparatus has provided therein a document feed sensor 124 located in conjunction with the document supply tray 100 of the document supply unit 90. The document feed sensor 124 is responsive to the presence or absence of at least one document sheet on the document supply tray 100 and is operative to produce an output signal $S_{DF}$ of a logic "1" state in the presence of a document sheet on the tray 100. On the other hand, the document transport unit 92 has provided therein a document size sensor 126. The document size sensor 126 is located adjacent the inlet of the document transport unit 92 and is responsive to passage of a document sheet into the document transport unit 92 to produce an output signal $S_{DS}$ indicative of the size of the document sheet typically as any one of the standardized A3, B4, A4 and B5 sizes.

Figure 2:
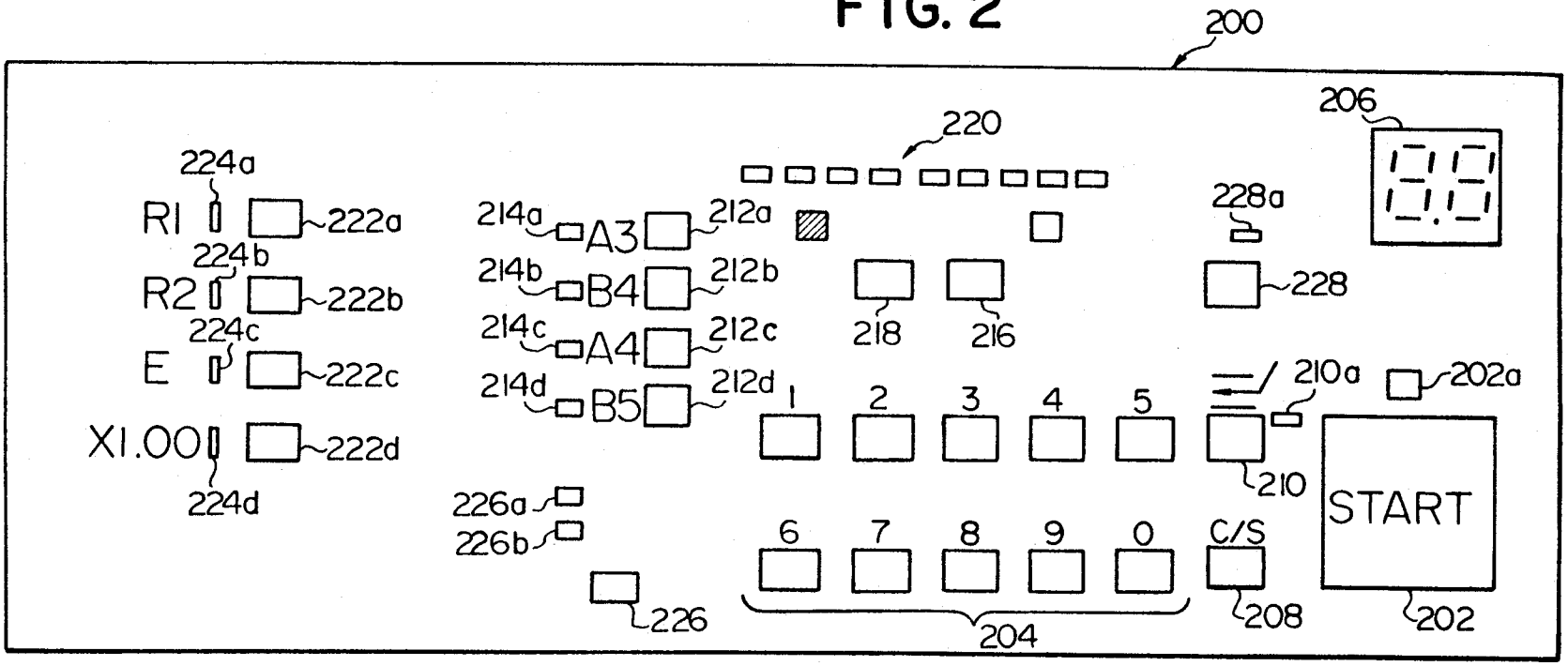
FIG. 2 is a plan view schematically showing the general configuration of the control panel forming part of the image duplicating apparatus embodying the present invention.

The various functions achievable by the image duplicating apparatus embodying the present invention will be understood from the following description regarding the general configuration of a control panel forming part of the image duplicating apparatus. FIG. 2 shows the general configuration of the control panel which is in its entirely represented by reference numeral 200.

Referring to FIG. 2, the control panel 200 comprises a print start key 202 (START) to start duplicating operation and a set of numerical keys 204 allocated to numerals 1, 2, . . . and 0, respectively. With the print start key 202 depressed, there is a print-start signal $S_{PS}$ of a logic "1" state produced in the control panel 200 to indicate that the system is required to operate a copying operation for a given document sheet. The numerical keys 204 are typically used to enter a desired number of printed outputs. The desired number of printed output thus entered from the numerical keys 204 is displayed on a seven-segment display window 206 and can be cleared from a clear/stop key 208 (C/S) which may be used also for cancelling the instruction once entered from the print start key 202. During printing of a preset quantity of copy sheets for a given document sheet, another document sheet may be duplicated in an interrupt mode entered at an interrupt request key 210 having an associated indicator lamp 210*a*.

The size of copy sheets to be used can be selected at manual document-size select keys 212*a*, 212*b*, 212*c* and 212*d* from among a predetermined number of document sizes available. In the key arrangement herein shown the document-size select keys 212*a*, 212*b*, 212*c* and 212*d* are assumed to be assigned to document sheets of the standardized A3, B4, A4 and B5 sizes, respectively. The selected document size is displayed by any of paper-size indicator lamps 214*a* to 214*d* which are associated with the keys 212*a* to 212*d*, respectively, as shown. Further provided are print density increment and decrement keys 216 and 218 to permit manual selection of a desired print density for the copy sheets to be printed. The print density is stepwise incremented with the key 216 depressed or decremented with the key 218 depressed. A series of print density display indicators 220 are activated to illuminate successively in one direction with the increment key 216 kept depressed and in the other direction with the decrement key 218 kept depressed.

On the control panel 200 are further provided a set of magnification ratio select keys 222*a*, 222*b*, 222*c* and 222*d* having respectively associated indicators 224*a*, 224*b*, 224*c* and 224*d*. The keys 222*a* to 222*d* are assumed to be used for the selection of any of first-ratio reduced copying (R1), second-ratio reduced copying (R2), magnified copying (E) and one-to-one ratio copying (×1,00) modes, respectively. With one of the keys 222*a* to 222*d* depressed, the associated one of the indicators 224*a* to 224*d* is activated to illuminate to indicate the selected ratio of reduction or magnification. Further provided on the control panel 200 is a color select key 226 to select any of prescribed print colors typically including black. The color select key 226 has associated indicator lamps 226*a* and 226*b* which are to indicate a selected color is, in effect, operative to select one of the two developing units 50*a* and 50*b* of the image developing stage 50 and has associated indicator lamps 226*a* and 226*b* which are to indicate one of the colors available with the developing units 50*a* and 50*b*. Indicated at 228 is a memory mode select key to be used to establish a program memory mode for storing a set of instructions entered at any of the various keys provided on the control panel 200. The memory mode select key 228 has an associated indicator lamp 228*a* which is to be activated to illuminate when such a memory mode is established with the key 228 depressed. A memory-mode select signal $S_{MM}$ of a logic "1" state is produced in the control panel 200 when the memory mode select key 228 is thus depressed to establish the memory mode. Each of the keys thus provided on the control panel 200 is implemented typically by a normally-open switch.

Figure 3A:
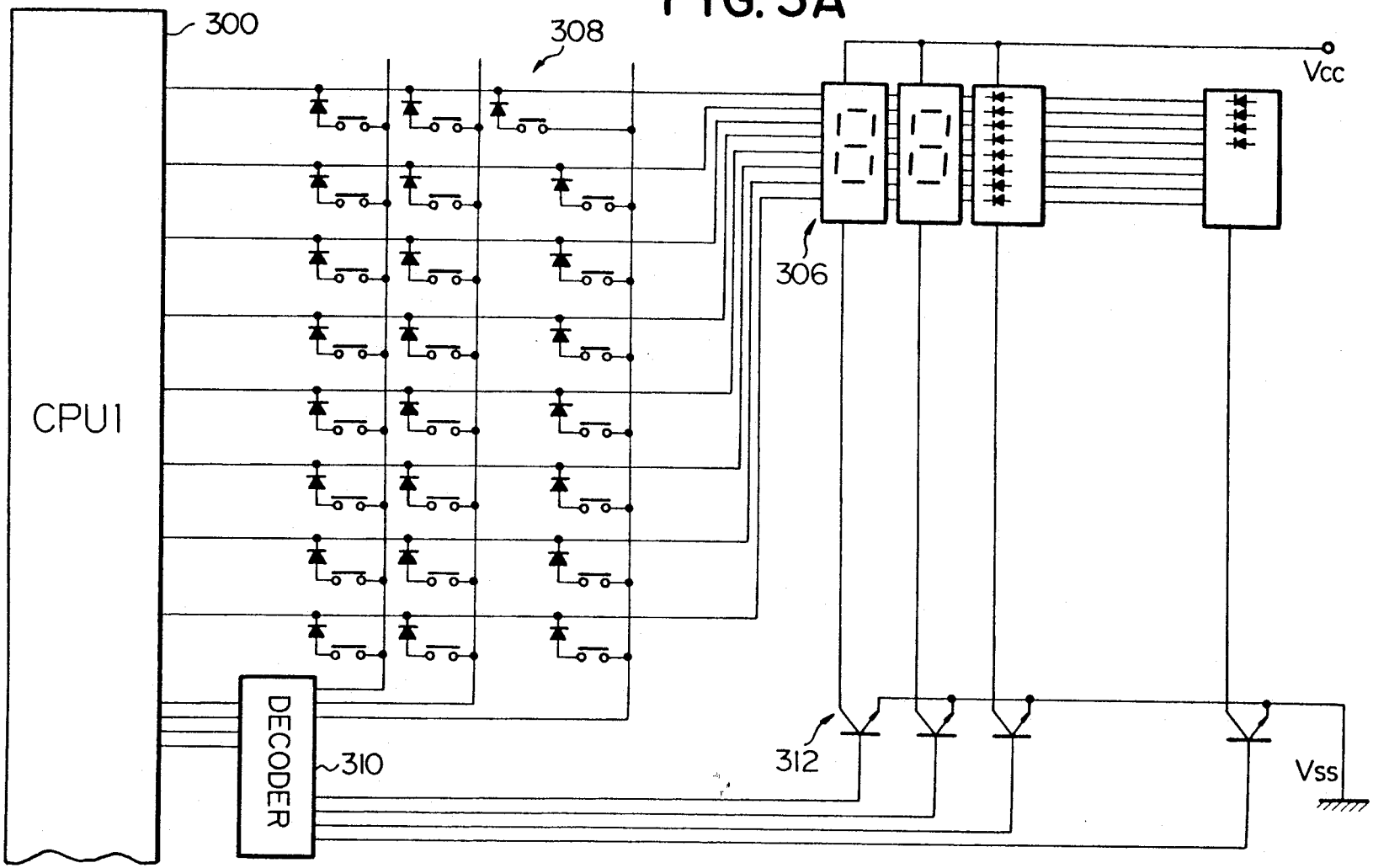
FIGS. 3A and 3B are complementary block diagrams schematically showing the general arrangement of a control circuit which may be incorporated in the image duplicating apparatus embodying the present invention.
Figure 3B:
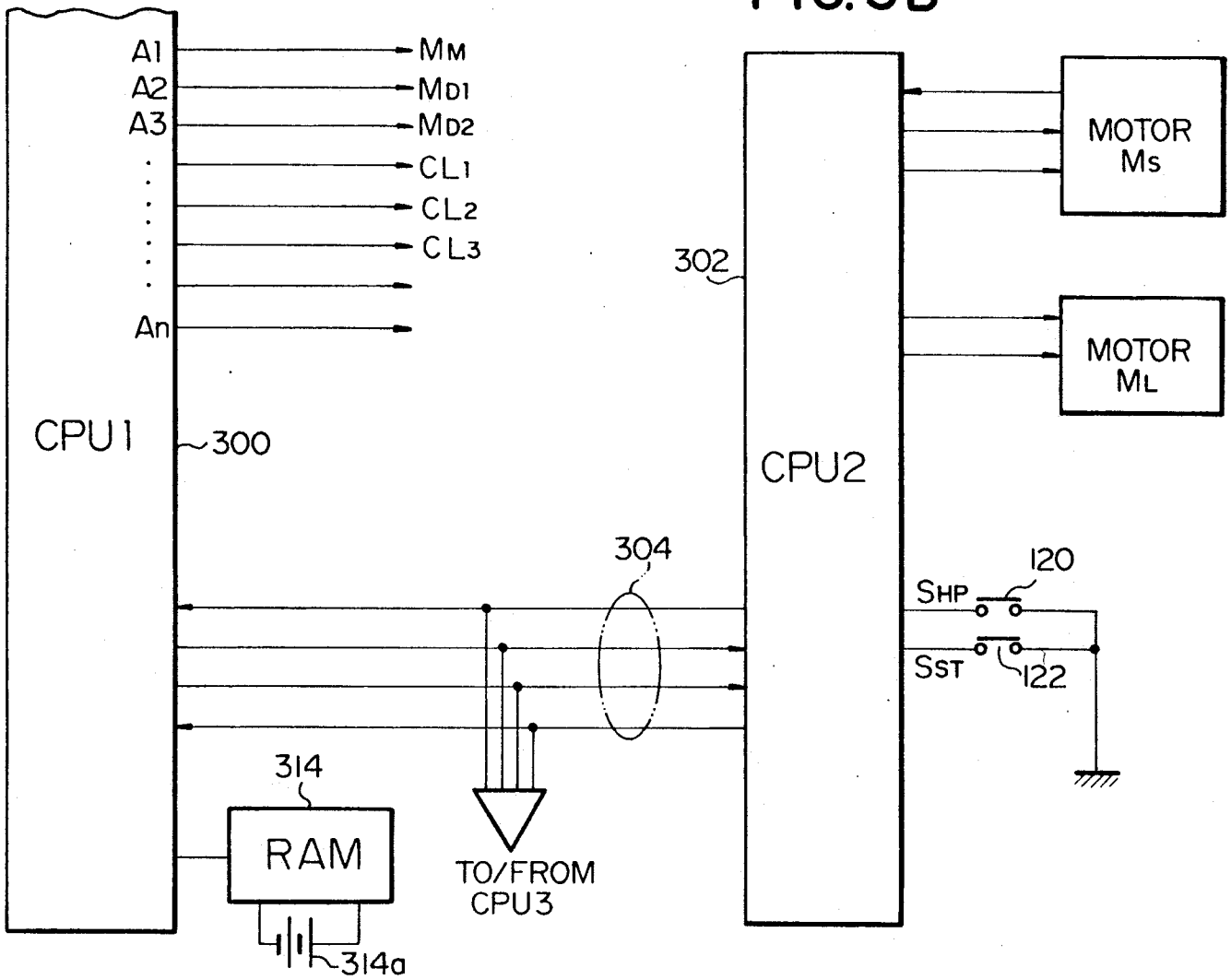
Figure 4:
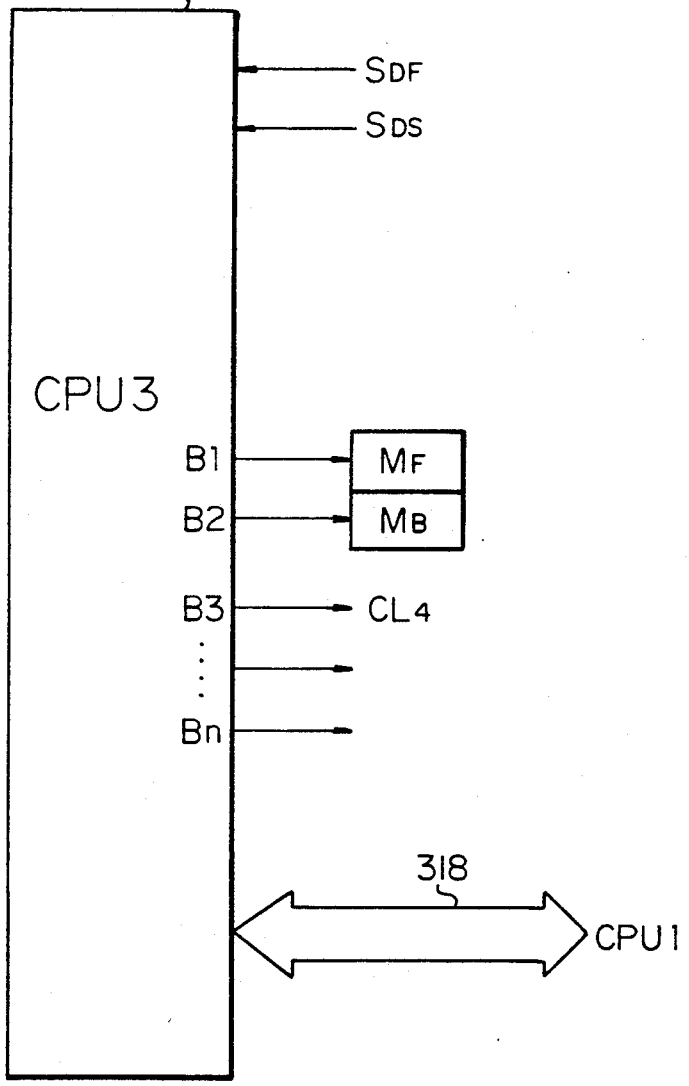
FIG. 4 is a block diagram schematically showing a cpu additionally incorporated in the control circuit illustrated in FIGS. 3A and 3B.

FIGS. 3A and 3B show the general arrangement of a control circuit which may be used to achieve the functions described with reference to FIG. 2. The control circuit comprises first and second central processing units 300 and 302 (CPU1 and CPU2) which have interrupt (INT) and data input and output ($S_{IN}$, $S_{OUT}$) ports connected together through bus lines 304. The first central processing unit 300 is operative to control the operation of the image reproducing system 16 and paper feed mechanism 22 while the second central processing unit 302 is predominant over the operation of the optical scanning system 20.

The first central processing unit 300 has input terminals connected to a matrix circuit 308 composed of normally-open switch elements including those associated with the various keys provided on the control panel 200 and the segment electrodes of the display window 206 on the control panel 200. The central processing unit 300 further has output terminals including those connected through an address decoder 310 to the matrix circuit 308 and to switch elements 312 for the display window 206. The central processing unit 300 further has terminals A1, A2, . . . An connected to switch and actuator elements of the driver circuits for the various electrically driven units. These units include the main drive motor 46 ($M_M$), the developer drive motors 52 ($M_{D1}$, $M_{D2}$), and the clutches ($CL_1$, $CL_2$, $CL_3$) for the paper feed and timing rollers 66, 68 and 74, as shown, as well as the chargers 48, 54 and 56 and eraser lamp 60. The first central processing unit 300 is further connected to a random-access memory (RAM) 314 for storing programs dictating various copying modes and conditions, the memory 314 having a backup power supply 314*a*.

The random-access memory 314 has a number of memory areas which include:

memory areas A3NMB, B4NMB, A4NMB and B5NMB to store data representative of the numbers of printed outputs to be produced for document sheets of the standardized A3, B4, A4 and B5 sizes, respectively;

memory areas A3MAG, B4MAG, A4MAG and B5MAG to store data representative of the magnification ratios to be used for document sheets of the standardized A3, B4, A4 and B5 sizes, respectively; and memory areas A3CLR, B4CLR, A4CLR and B5CLR to store data representative of the print colors to be used for document sheets of the standardized A3, B4, A4 and B5 sizes, respectively.

The second central processing unit 302 has input terminals connected to the home position and scan timing sensors 120 and 122 provided in association with the optical scanning system 20 and is operative to control the driver circuits for the scanner drive motor 40 ($M_S$) and the stepper motor 42 ($M_L$) for the magnification lens unit 36. The central processing unit 302 is thus responsive to the signals $S_{HP}$ and $S_{ST}$ from the home position and scan timing sensors 120 and 122, respectively, to regulate the operation of the motors 40 and 42 of the optical scanning system 20 under the control of the first central processing unit 300 through the bus lines 304.

The control circuit of the system embodying the present invention further comprises a third central processing unit 316 predominant over the operation of the automatic document feed module 12. The third central processing unit 316 has interrupt and data input and output ports connected together through bus lines 318 to the first central processing unit 300 and input terminals connected to the document feed sensor 124 and document size sensor 126 provided in the automatic document feed module 12. The third central processing unit 316 is thus responsive to the signal $S_{DF}$ and $S_{DS}$ from the document feed sensor 124 and document size sensor 126 and produces an ADF ready signal $S_{READY}$ of a logic "1" state in response to the signal $S_{DF}$ and $S_{DS}$ produced from the document feed sensor 124 and document size sensor 126 after the scanning of a document sheet is terminated and the document sheet is withdrawn from the automatic document feed module 12. The third central processing unit 316 further has output terminals B1, B2, . . . Bn connected to switch and actuator elements of the driver circuits for the various electrically driven units in the automatic document feed module 12. These units include the roller drive motor 104 ($M_F$), the belt drive motor 116 ($M_B$), and the clutch ($CL_4$) for the belt drive roller 108.

Figure 5:
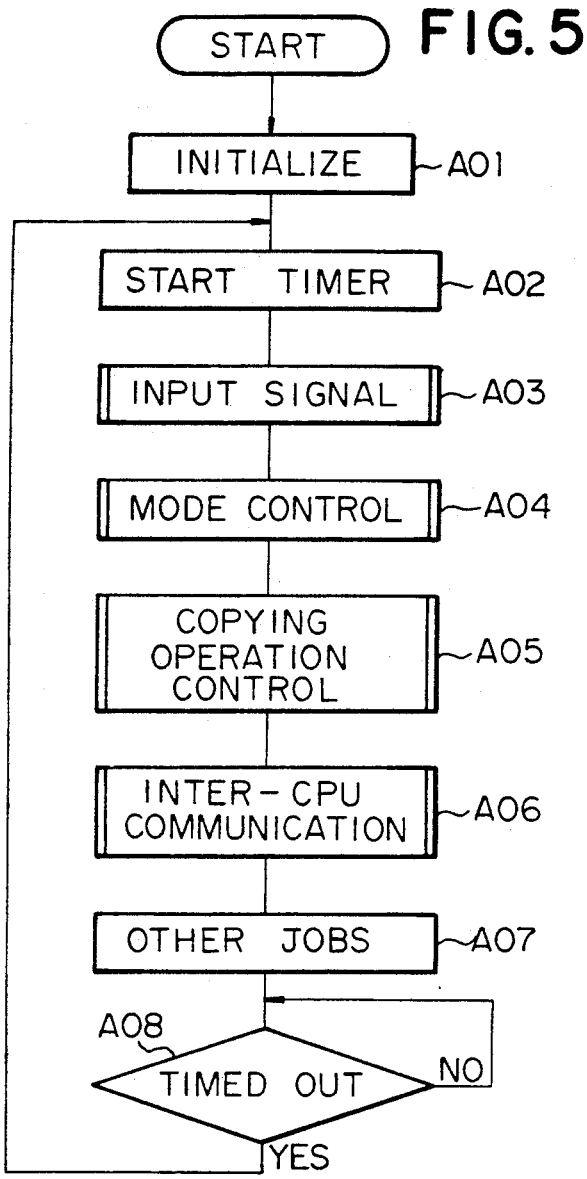
FIG. 5 a flowchart showing a preferred example of the main routine program to be executed by a master cpu included in the control circuit illustrated in FIGS. 3A and 3B.

FIG. 5 shows a preferred example of the main routine program to be executed by the master central processing unit 300. Referring to FIG. 5, the execution of such a main routine program is started with the apparatus switched on to initialize the central processing unit 300 at step A01. All the data representative of the copying conditions and modes of operation that may have been memorized in the memory 314 and registers of the central processing unit 300 are thus initialized in accordance with prescribed "default" rules. An internal timer of the central processing unit 300 is then started at step A02 to count a time interval predetermined for a single complete iteration through the routine program. The master central processing unit 300 may then execute a signal input subroutine program A03 by means of which the signals produced with any of the various keys on the control panel 200 depressed are input to the central processing unit 300 and the data resulting therefrom may be stored into the memory 314.

The main routine program to be executed by the master central processing unit 300 further includes a mode control subroutine program A04 in which data generated as being representative of the desired operational conditions for specific document sizes may be stored into appropriate memory areas of the memory 314 and may be fetched from the memory 314 and loaded into appropriate ones of the registers in the central processing unit 300. The details of this mode control subroutine program A04 will be hereinafter described with reference to FIGS. 6, 7 and 8. The master central processing unit 300 may further execute a copying control subroutine program A05 by means of which copying operation is performed in accordance with the conditions selected through the subroutine program A03 or the subroutine program A04. The master central processing unit 300 may execute a subroutine program A06 to communicate with the second and third central processing unit 302 for the control of the optical scanning system 20 of the duplicator module 10 and with the third central processing unit 316 for the control of the automatic document feed module 12.

The master central processing unit 300 may then proceed to other subroutine programs to perform other jobs required for performing various modes of operation or operation under various other conditions. Upon lapse of the time counted by the internal timer of the central processing unit 300 as started at step A02, the central processing unit 300 reverts to the step A02 and recycles the subroutine programs A03 to A07.

Description will be hereinafter made with reference to FIGS. 6 to 8 in regard to the mode control subroutine program A04 included in the main routine program hereinbefore described.

Figure 6:
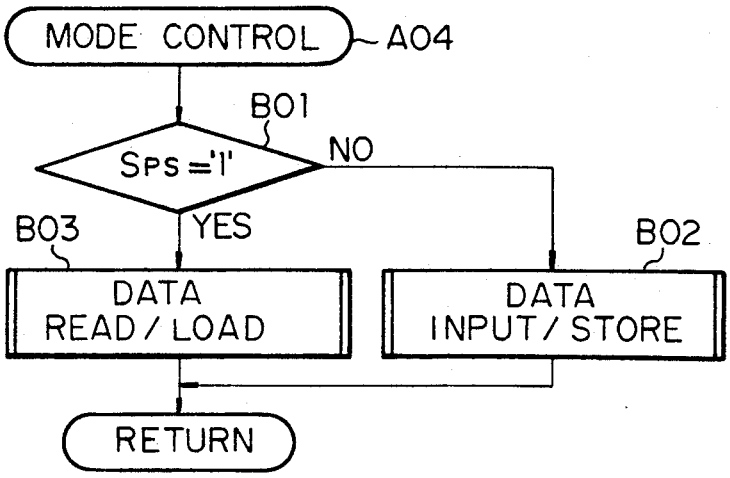
FIG. 6 is a flowchart showing the details of a mode control subroutine program included in the main routine program illustrated in FIG. 5.

FIG. 6 shows the details of the print control subroutine program A03 included in the main routine program described with reference to FIG. 5.

Referring to FIG. 6, the mode control subroutine program A04 starts with a decision step at B01 at which it is confirmed whether or not there is a change in the logic state of the print-start signal $S_{PS}$ from logic "0" to logic "1" with the print start key 202 depressed. In the absence of such a change, the central processing unit 300 proceeds to a data input/store subroutine program B02 to generate data in accordance with the signals produced in the control panel 200 and store the data into the memory 314. The details of this data input/-store subroutine program B02 are depicted in FIG. 7. If it is found at the decision step B01 that there is a change in the logic state of the print-start signal $S_{PS}$ from logic "0" to logic "1" state, then the central processing unit 300 proceeds to a data read/load subroutine program B03 to read the data thus stored in the memory 314 and load the data into appropriate ones of the registers of the central processing unit 300. The details of this data read/load subroutine program B03 will be hereinafter described with reference to FIG. 8.

Figure 7:
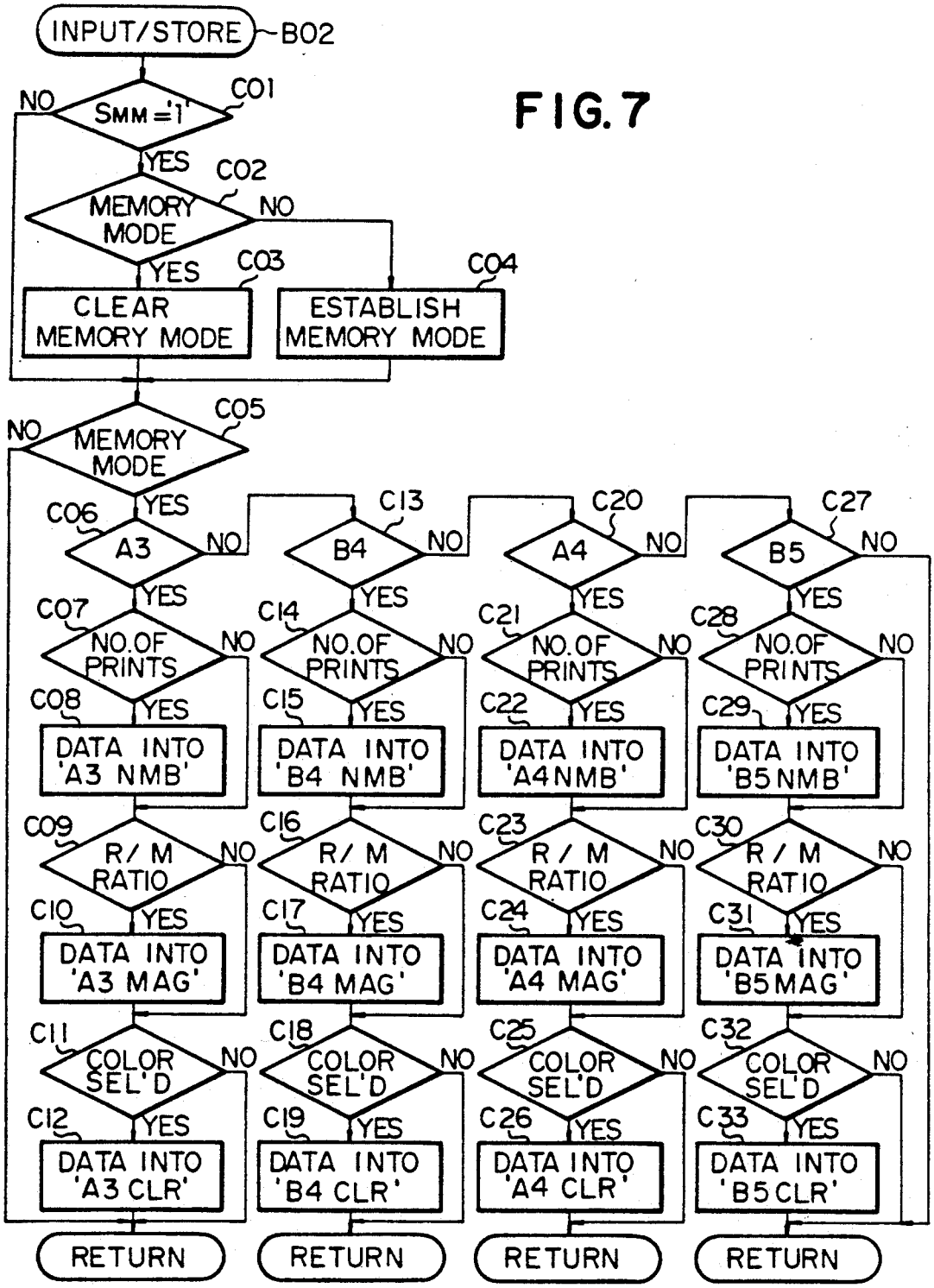
FIG. 7 is a flowchart showing the details of a data read/load subroutine program included in the mode control subroutine program illustrated in FIG. 6.

Referring to FIG. 7, the data input/store subroutine program B02 starts with a decision step C01 at which it is tested whether or not the logic state of the memory-mode select signal $S_{MM}$ has changed from logic "0" to logic "1" state with the memory mode select key 228 newly depressed. If it is found that there is such a signal $S_{MM}$, it is tested at step C02 whether or not the memory mode has been established in the central processing unit 300. If the answer for this step C02 is given in the affirmative, the subroutine program proceeds to step C03 to clear the memory mode and, if in the negative, then proceeds to step C04 to newly establish the memory mode.

Subsequent to step C03 or step C04 or when the answer for the step C01 is given in the negative, it is further questioned at step C05 whether or not the memory mode is currently established in the central processing unit 300. If the answer for this step step C05 is given in the negative, the program returns to step A05 of the main routine program without performing any jobs.

If it is found at step C05 that the memory mode is established, then the central processing unit 300 proceeds to any of a plurality of series of steps C06 to C12, steps C13 to C19, steps C20 to C26, and steps C27 to C33 so that data representative of the number of the printed outputs to be produced, the magnification ratio, and the print color are stored into specified memory areas of the memory 314.

Thus, at any of the steps C06, C13, C20 and C27 is checked whether or not the size of the document sheet to be duplicated is the standardized A3, B4, A4 or B5 size. This test is made through detection of the signal activating any of the indicator lamps 214*a* to 214*d* associated with the document-size select keys 212*a* to 212*d*, respectively. If the answer for every one of these steps C06, C13, C20 and C27 is given in the negative in the absence of the data selecting any of the standardized A3, B4, A4 or B5 sizes, the subroutine program B02 also reverts to step C01.

If it is found at any of the steps C06, C13, C20 and C27 that the size of the document sheet to be duplicated is the standardized A3, B4, A4 or B5 size, it is further tested at any of steps C07, C14, C21 and C28 whether or not there is a data produced to specify the number of the printed outputs to be produced. This data is generated with any of the numerical switches 204 depressed. If it is found at any of the steps C07, C14, C21 and C28 that there is such a data present, the data representative of the specified number of printed outputs is stored at any of the steps C08, C15, C22 and C29 into any one of the memory areas A3NMB, B4NMB, A4NMB or B5NMB of the memory 314 depending on the document size detected at any of the steps C06, C13, C20 and C27.

Subsequent to the step C08, C15, C22 or C29 or if the answer for the step C07, C14, C21 or C28 is given in the negative, it is tested at any of steps C09, C16, C23 and C30 whether or not there is a data produced to specify the reduction/magnification ratio to be used for the programmed copying operation. This test is made through detection of the signal activating any of the indicator lamps 224*a* to 224*d* associated with the reduction/magnification ratio select keys 222*a* to 222*d*, respectively. If it is found at step C09, C16, C23 or C30 that there is such a data present, the data representative of the selected reduction/magnification ratio is stored at step C10, C17, C24 and C31 into any one of the memory areas A3MAG, B4MAG, A4MAG or B5MAG of the memory 314 depending on the document size detected at any of the steps C06, C13, C20 and C27. Subsequent to the step C10, C17, C24 or C31 or if the answer for the step C09, C16, C23 or C30 is given in the negative, it is tested at any of steps C11, C18, C25 and C32 whether or not there is a data produced to specify the print color to be used for the programmed copying operation. This test is made through detection of the signal activating one of the indicator lamps 226*a* and 226*b* associated with the color select key 226. If it is found at step C11, C18, C25 or C32 that there is such a data present, the data thus representative of the selected print color is stored at step C12, C19, C26 and C33 into any one of the memory areas A3CLR, B4CLR, A4CLR or B5CLR of the memory 314 depending on the document size detected at any of the steps C06, C13, C20 and C27.

Subsequent to the step C12, C19, C26 or C33 or if the answer for the step C11, C18, C25 and C32 is given in the negative, the program returns to step A01 of the main routine program.

From the above description of the input/store subroutine in combination with the CPU1 300, it can be seen that the image duplicating apparatus includes a data write means that writes into one of the memory areas the data representative of one of the operation conditions.

Figure 8:
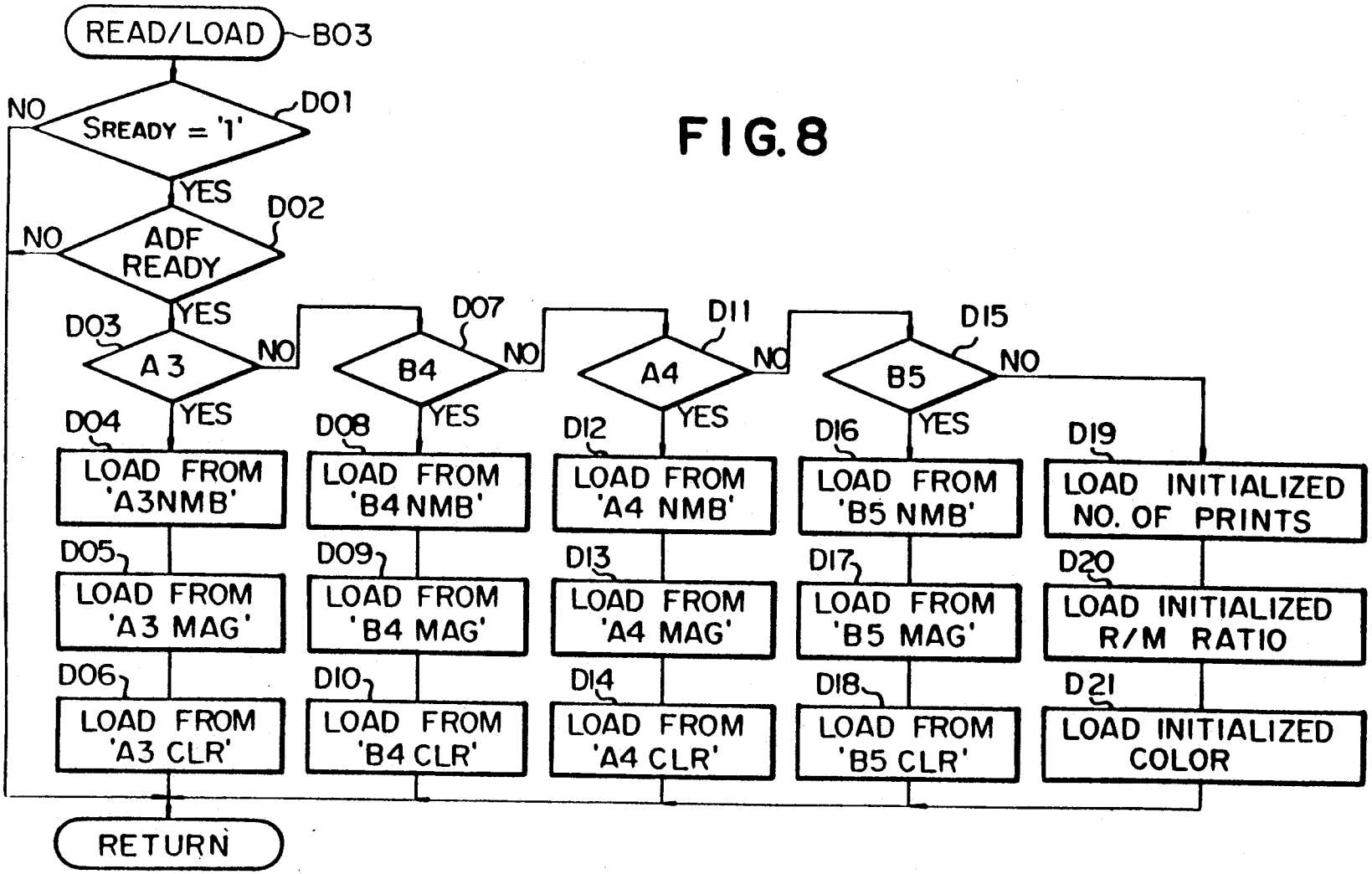
FIG. 8 is a flowchart showing the details of a data input/store subroutine program also included in the mode control subroutine program illustrated in FIG. 6.

Turning to FIG. 8, the data read/load subroutine program B03 starts with a decision step D01 at which it is tested whether or not there is an ADF ready signal $S_{READY}$ of a logic "1" state produced by the third central processing unit 316 whether the document sheet set on the document support table 16 by means of the automatic document feed module 12 after the scanning of the preceding document sheet is terminated. If it is found that there is such a signal $S_{READY}$, it is tested at step D02 whether or not the automatic document feed module 12 is ready for operation. If the answer for the step step D01 or the step D02 is given in the negative, the program returns to step A01 of the main routine program without performing any jobs.

If it is found at step D02 that there is the ADF ready signal $S_{READY}$ of logic "1" state, then the central processing unit 300 proceeds to any of a plurality of series of steps D03 to D06, steps D07 to D10, steps D11 to D14, steps D15 to D18, and steps D19 to C21 to fetch from the memory 314 the data representative of the number of the printed outputs to be produced, the magnification ratio, and the print color and load the data into appropriate ones of the registers of the central processing unit 300.

Thus, at any of the steps D03, D07, D11 and D15 is checked whether or not the size of the document sheet to be duplicated is the standardized A3, B4, A4 or B5 size in response to the signal $S_{DS}$ produced from the document size sensor 126. If it is found at step D03 that the size of the document sheet to be duplicated is the standardized A3, the step D03 is followed by steps D04, D05 and D06 to read data from the memory areas A3NMB, A3MAG and A3CLR of the memory 314. Likewise, the step D07, D11 or D15 is followed by steps D08, D09 and D10, steps D11, D12 and D13, or steps D15, D16 and D17 to read data from the memory areas B4NMB, B4MAG and B4CLR, memory areas A4NMB, A4MAG and A4CLR, or memory areas B5NMB, B5MAG and B5CLR, respectively, of the memory 314. The data thus representing the number of the printed outputs to be produced and the reduction/-magnification ratio and print color to be used for the programmed copying operation are loaded into appropriate ones of the registers in the central processing unit 300.

If the answer for every one of these steps D06, D13, D20 and D27 is given in the negative in the absence of the data selecting any of the standardized A3, B4, A4 or B5 sizes, the subroutine program B03 proceeds to the series of step D19, D20 and D21. At these step D19, D20 and D21, the data representative the number of the printed outputs, the reduction/magnification ratio and the print color specified in accordance with the default rules at the step A01 of the main routine program are loaded into appropriate ones of the registers in the central processing unit 300. Subsequently to the step D06, D10, D14, D18 or D21, the program B03 returns to step A01 of the main routine program.

From the foregoing description of the data read/load subroutine in combination with the CPU1 300, it can be seen that the image duplicating apparatus includes a data read means for reading from the storage areas data representative of the operational conditions for the individual natures of document sheets.

It will have been understood from the foregoing description that, if desired operational conditions such as the desired number of printed outputs, reduction/-magnification ratio and print color for the programmed copying operation may be preliminarily stored into the memory 314 through the control panel 200, the data representative of such operational conditions are read out from the memory 314 each time the size of the document sheet supplied to the automatic document feed module 12 is detected. While it has been assumed that a document sheet to be duplicated is supplied by means of the document feed module 12, the document may be manually supplied and placed on the document support table 18. Furthermore, the gist of the present invention may be realized not only in an image duplicating apparatus including the automatic document feed module but also in an apparatus devoid of such an additional module. Where the present invention is to be applied to an image duplicating apparatus thus devoid of an automatic document feed module, the sensors such as the document size sensor 126 may be located within the duplicator module 10 per se.

Although the operational conditions to be preselected for the programmed copying operation have been exemplified by the desired number of printed outputs, reduction/magnification ratio and print color for the programmed copying operation, other operational conditions and parameters such as the intensity of light with which a document sheet is to be scanned and some operational conditions used in an optional equipment such as a page sorter may be used for the programmed copying operation. While, furthermore, the data representative of the preselected operational conditions are manipulated depending on the sizes of document sheets, the data to be used for the programmed copying operation may be manipulated for other natures or indices of document sheets such as for example the lengths or colors of document sheets or any markings applied to document sheets.

What is claimed is:

1. An image duplicating apparatus comprising:

a) detecting means for detecting respective natures of document sheets to be duplicated;

b) input means for entering user modifiable data representative of operational conditions in accordance with which a document sheet having any of said natures is to be duplicated;

c) data storage means for storing the data representative of the respective operational conditions for said natures of document sheets; and d) copying operation performing means responsive to said detecting means for reading from said storage means the data representative of the respective operation conditions for the individual natures of document sheets detected by said detecting means, and for performing a copying operation in accordance with the operational conditions represented by the data read from said storage means.

2. An image duplicating apparatus as set forth in claim 1, in which said copying operation performing means is operative to perform a copying operation in accordance with operational conditions input by said input means when it is found that said memory means has no memory area corresponding to the nature of document sheets detected by said detecting means.

3. An image duplicating apparatus as set forth in claim 2, in which said detecting means is operative to detect sizes of document sheets.

4. An image duplicating apparatus as set forth in claim 3, in which said input means comprises a plurality of switches through which a signal representative of a desired number of printed outputs is to be produced as said data.

5. An image duplicating apparatus comprising;

a) document feed means for successively feeding document sheets to a predetermined position;

b) detecting means for detecting respective natures of document sheets which are each fed to or which are each to be fed to said predetermined position;

c) input means for entering user modifiable data representative of operational conditions in accordance with which a document sheet having any of said natures is to be duplicated;

d) data storage means for storing the data representative of the respective operational conditions for said natures of document sheets;

e) copying operation performing means responsive to said detecting means for reading from said storage means the data representative of the operational conditions for the individual natures of document sheets detected by said detecting means, and for performing a copying operation for a document sheet fed to said predetermined position, said performing copying operation being performed in accordance with the operational conditions represented by the data read from said storage means.

6. An image duplicating apparatus as set forth in claim 5, in which said copying operation performing means is operative to perform a copying operation in accordance with operational conditions input by said input means when it is found that said memory means has no memory area corresponding to the nature of document sheets detected by said detecting means.

7. An image duplicating apparatus as set forth in claim 6, in which said detecting means is operative to detect sizes of document sheets.

8. An image duplicating apparatus as set forth in claim 7, in which said input means comprises a plurality of switches through which a signal representative of a desired number of printed outputs is to be produced as said data.

9. An image duplicating apparatus comprising:

a) detecting means for detecting respective natures of document sheets to be duplicated;

b) input means for entering user modifiable data representative of preselected operational conditions;

c) data storage means having a plurality of memory areas for storing the data representative of the respective operational conditions, said memory areas being respectively assigned to said natures of document sheets;

d) selecting means for selecting any one of said memory areas;

e) data store means for storing into a selected one of said memory areas the data representative of the respective operational condition;

f) data read means responsive to said detecting means for reading from said storage means the data representative of the operational conditions for the individual natures of document sheets, the data representative of the operational conditions being read from said memory areas which correspond respectively to the natures of document sheets detected by said detecting means; and g) copying operation performing means for performing a copying operation in accordance with the operational conditions represented by the data read by said data read means.

10. An image duplicating apparatus as set forth in claim 9, in which said copying operation performing means is operative to perform a copying operation in accordance with operational conditions input by said input means when it is found that said memory means has no memory area corresponding to the nature of document sheets detected by said detecting means.

11. An image duplicating apparatus as set forth in claim 10, in which said detecting means is operative to detect sizes of document sheets.

12. An image duplicating apparatus as set forth in claim 11, in which said input means comprises a plurality of switches through which a signal representative of a desired number of printed outputs is to be produced as said data, said selecting means comprising a plurality of switches which correspond in number to different predetermined sizes available.

* * * * *